US006363542B1

(12) United States Patent
Pope, Sr.

(10) Patent No.: US 6,363,542 B1
(45) Date of Patent: Apr. 2, 2002

(54) TOILET VENTILATOR

(76) Inventor: George G. Pope, Sr., 1914 Nation Rd., Hodges, SC (US) 29653

( * ) Notice: Subject to any disclaimer, the term of this patent is extended or adjusted under 35 U.S.C. 154(b) by 0 days.

(21) Appl. No.: 09/557,446

(22) Filed: Apr. 25, 2000

(51) Int. Cl.[7] ..... E03D 9/05
(52) U.S. Cl. ..... 4/209 R; 4/218
(58) Field of Search ..... 4/209 R, 211, 4/216, 217, 218, 219, 220, 221, 213

(56) References Cited

U.S. PATENT DOCUMENTS

| | | | | |
|---|---|---|---|---|
| 1,700,936 A | | 2/1929 | Klemish et al. | |
| 1,861,501 A | | 6/1932 | Lowther | |
| 1,894,846 A | | 1/1933 | Bennett | |
| 1,997,695 A | | 4/1935 | Nielsen et al. | 4/213 |
| 2,072,493 A | | 3/1937 | Beard | 4/213 |
| 2,072,780 A | * | 3/1937 | Turner | 4/218 |
| 2,151,138 A | | 3/1939 | Morris | 4/213 |
| 2,171,903 A | | 9/1939 | St. Aubin | 4/213 |
| 3,896,509 A | * | 7/1975 | Stipp et al. | 4/209 R |
| 3,900,908 A | * | 8/1975 | Stump | 4/213 |
| 4,494,255 A | * | 1/1985 | Drummond | 4/211 |
| 4,524,262 A | * | 6/1985 | Meyer | 4/218 |
| 5,253,371 A | * | 10/1993 | Slawinski | 4/213 |
| 5,386,594 A | * | 2/1995 | Hilton | 4/213 |
| 5,781,937 A | | 7/1998 | Liang | 4/213 |
| 5,875,496 A | * | 3/1999 | Schaffer | 4/213 |
| 5,906,009 A | * | 5/1999 | Sakar | 4/213 |

OTHER PUBLICATIONS

Forest Service Research Note: "The Convection Stack: —A Device for Ridding Pit Toilets of Bad Odor," Jan. 1963.*

* cited by examiner

*Primary Examiner*—Charles R. Eloshway
(74) *Attorney, Agent, or Firm*—Flint & Kim, P.A.

(57) ABSTRACT

A toilet ventilation apparatus which can either be attached to an existing toilet in a structure as an after market product or manufactured in combination with a toilet. The toilet ventilator draws odors directly from the toilet bowl through an intake duct and exhaust manifold through at least one connector duct into a heat resistant draft box with said odor being expelled through an exhaust pipe into an outside environment. The toilet ventilator accomplishes this by incorporating the physics law of rising heat in order to create a draft to draw toilet bowl odors up and out. A motion detector switches on the heat source, possibly a light bulb, and a time delay keeps the heat source on and the apparatus functioning for a predetermined period of time. A draft could also be created by connecting to and utilizing the hot air in an attic. The exhaust manifold fits under the back of the toilet seat and rests under the toilet tank with spacers for added space and support of the tank. A gasket is disposed within the toilet's central opening which is centered within the manifold opening in order to prevent water leakage when it is transferred from tank to bowl via the openings and gasket. A seal can be attached to the underside of the toilet lid to further prevent the escape of odors not drawn in by the exhaust manifold. The draft box, preferably made of heat resistant sheet metal, can be placed either within an adjacent wall or above the toilet tank and perhaps housed in a cabinet for aesthetics. The exhaust pipe can vent either to the outside, within the adjacent wall or to the attic.

11 Claims, 4 Drawing Sheets

TOILET VENTILATOR

BACKGROUND OF THE INVENTION

This invention relates to the ventilation of toilets to better remove from the surrounding air the unpleasant odors that are a necessary by-product of normal bodily functions. This improved toilet ventilation system is not only easy to install and quiet in operation, but also reliable, easy to service, and cost efficient.

The introduction of affordable and effective widespread indoor plumbing was a huge convenience for both families and individuals alike. Trips to the outhouse in the middle of the night, or during cold or foul weather, were no longer necessary to tend to nature's call. Such treks were rendered obsolete, but the onset of indoor plumbing solved one set of problems and brought with it some others.

Now that the bathrooms were inside the home and included within the living quarters, so too were the offensive odors and fumes which accompany defecation. Opening a window for simple ventilation was not always possible or practical if the bathroom was not located next to an outside wall or the weather was cold or rainy. Consequently, numerous inventions have addressed the bathroom ventilation issue.

An early example of an attempt to solve this problem is U.S. Pat. No. 2,072,493. Here, the invention is the device incorporating a fan mounted either on or near the toilet, with the fan being activated by a switch embedded in the toilet seat. U.S. Pat. No. 1,894,846 combats bathroom odor problems by placing both a motor and a fan inside the toilet. The internal fan pulls in the rancid air through ventilation holes along the inside of the toilet seat. U.S. Pat. Nos. 2,171,903, 1,700,936, and 2,151,138 all similarly utilize costly and complicated fan and motor arrangements to achieve bathroom ventilation. U.S. Pat. No. 5,781,937 has a motor but uses a complex deodorizing system with the foul air being drawn through an antiseptic solution for purification purposes. However, the prior art has not provided a simple and inexpensive system with basic components that can be easily installed as original or aftermarket equipment.

Accordingly, an object of the present invention is to provide a simple toilet ventilator which removes foul bathroom odors before the odors escape from the toilet bowl and vents them either to an attic, to the outside, or between adjacent walls.

Another object of the present invention is to provide a toilet ventilator that is quiet, simple and inexpensive in cost and maintenance.

SUMMARY OF THE INVENTION

The above objectives are accomplished by the present invention in an apparatus that can be marketed in a toilet ventilator combination or as an after market toilet ventilator add on. The present invention rids the bathroom of unpleasant fumes through an exhaust manifold which is disposed between the toilet bowl and the toilet tank. The exhaust manifold communicates with the interior of the toilet bowl. The toilet tank may rest on top of the exhaust manifold which may have a central opening to allow water to pass from the toilet tank to the toilet bowl. At least one connector duct is connected to the back of the exhaust manifold. The unpleasant bathroom odors are drawn through the connector duct from the exhaust manifold into a draft box. The draft box houses a heat source, most advantageously a light bulb that turns on when a motion detector connected to the present invention detects a person approaching the commode. The motion detector is equipped with a time delay device that turns the heat source off after a predetermined period of time while heated air continues to rise and ventilate the toilet bowl. As the air surrounding the heat source heats up, it begins to rise and is carried out through the exhaust pipe connected to the draft box. The exhaust pipe can vent either to the outside, an attic, or even between the sheet rock of a wall. The draft box can be located either behind the wall adjacent to the toilet or can be located above the toilet tank.

To service the present invention there may be an access door cut into the wall so that a service door of the draft box can be easily accessed in order to service the draft box heat source. Access to the draft box would be less important if the invention were installed without an electric heat source, utilizing instead the hot air in an attic to create a draft and pull fumes upward.

There are many advantages of the present invention over the prior art. The exhaust manifold takes in the sullied air directly from the toilet bowl, thereby minimizing its escape into the room. The device is very efficient in this manner and as such works quickly as only the fumes are ventilated. The invention does not filter all of the air in the room. Although there are already patents which take fumes directly from the toilet bowl, these patents utilize fans to create the draft and the toilet user could potentially experience some unpleasant suction or airflow. The draft created by the present invention which removes odors is based on the simple law of physics that "heat rises."Accordingly, the shift in air is slight and unnoticeable, and may even be continuous. In contradistinction to ventilators using a fan and a motor, the present invention works silently. There are no disruptive motors or fans whirring away.

In not requiring a motor to operate, the present invention also has the advantage of easy maintenance. To service and maintain a toilet ventilator motor and the devices claimed in the majority of the prior art, it would be both costly and complicated for the consumer. The present invention, however, may be as simple as changing a light bulb. This convenience could be appreciated both in a family home or a restroom with heavy traffic, such as in a welcome center or restaurant.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will now be described in more detail.

Figure 1:
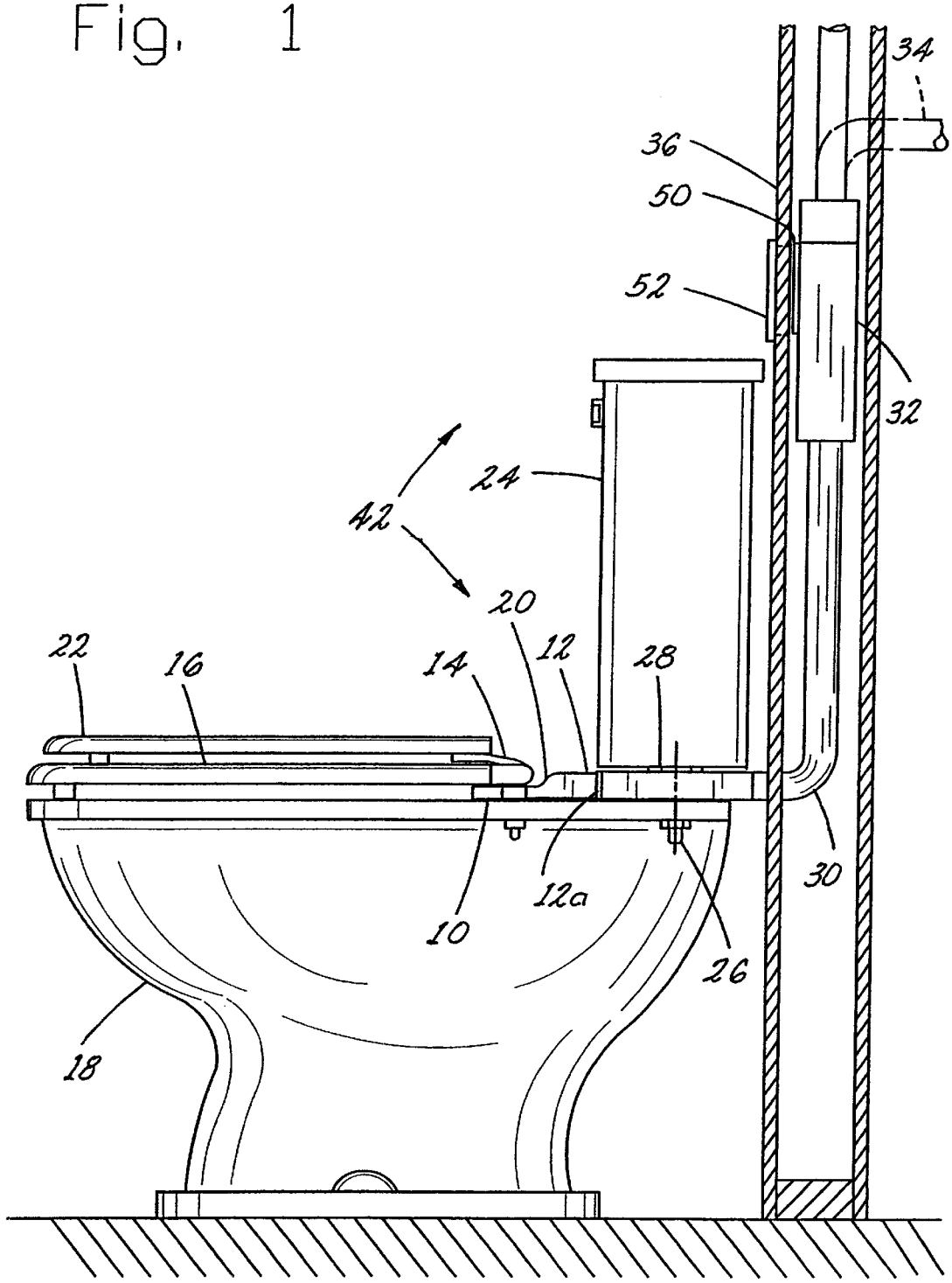
FIG. 1 is a side elevation illustrating an apparatus for toilet ventilation with the draft box being within an adjacent wall shown in combination with a toilet in accordance with one embodiment of the invention.

FIG. 1 illustrates the system for ventilating foul odors from a toilet shown in combination with a toilet, designated generally as A, which includes an intake duct 10 for drawing such fumes into an exhaust manifold 12. Exhaust manifold 12 and the intake duct 10 fit between toilet hinges 14 and under the toilet seat 16 in order to gain direct access to odors and prevent them from escaping the toilet bowl 18. The intake duct 10 is preferably removable for cleaning and replacement. For this purpose, a release attachment may be provided in the form of a reduced neck of the manifold 12*a* which fits into duct 10, or vice versa. The exhaust manifold 12 may be designed with a manifold adaptation 20 in order to accommodate both the toilet seat 16 and the toilet lid 22 when they are raised. The exhaust manifold 12 extends back under the toilet tank 24 and rests beneath the tank 24. The exhaust manifold 12 and the toilet tank 24 are secured using toilet tank connectors 26 and with the use of spacers 28 to make adequate room for the exhaust manifold 12 and to bear at least part of the weight of the toilet tank 24 as it rests on the exhaust manifold 12. At least one connector duct 30 attaches to the back of the exhaust manifold 12 and carries the foul odors to the draft box 32 which is preferably made of a heat resistant material, such as sheet metal, and then the odors are carried out through the exhaust pipe 34. Preferably, there are two such connector ducts 30.

FIG. 1 illustrates the apparatus in combination with a toilet A wherein two connector ducts 30 and a draft box 32 are housed within an adjacent wall 36 and the exhaust pipe 34 drawing the bathroom odors outside the building. This would be a preferred embodiment for incorporating the toilet ventilator apparatus into a building during its construction or remodeling, or for a bathroom located on an outside wall.

Figure 4:
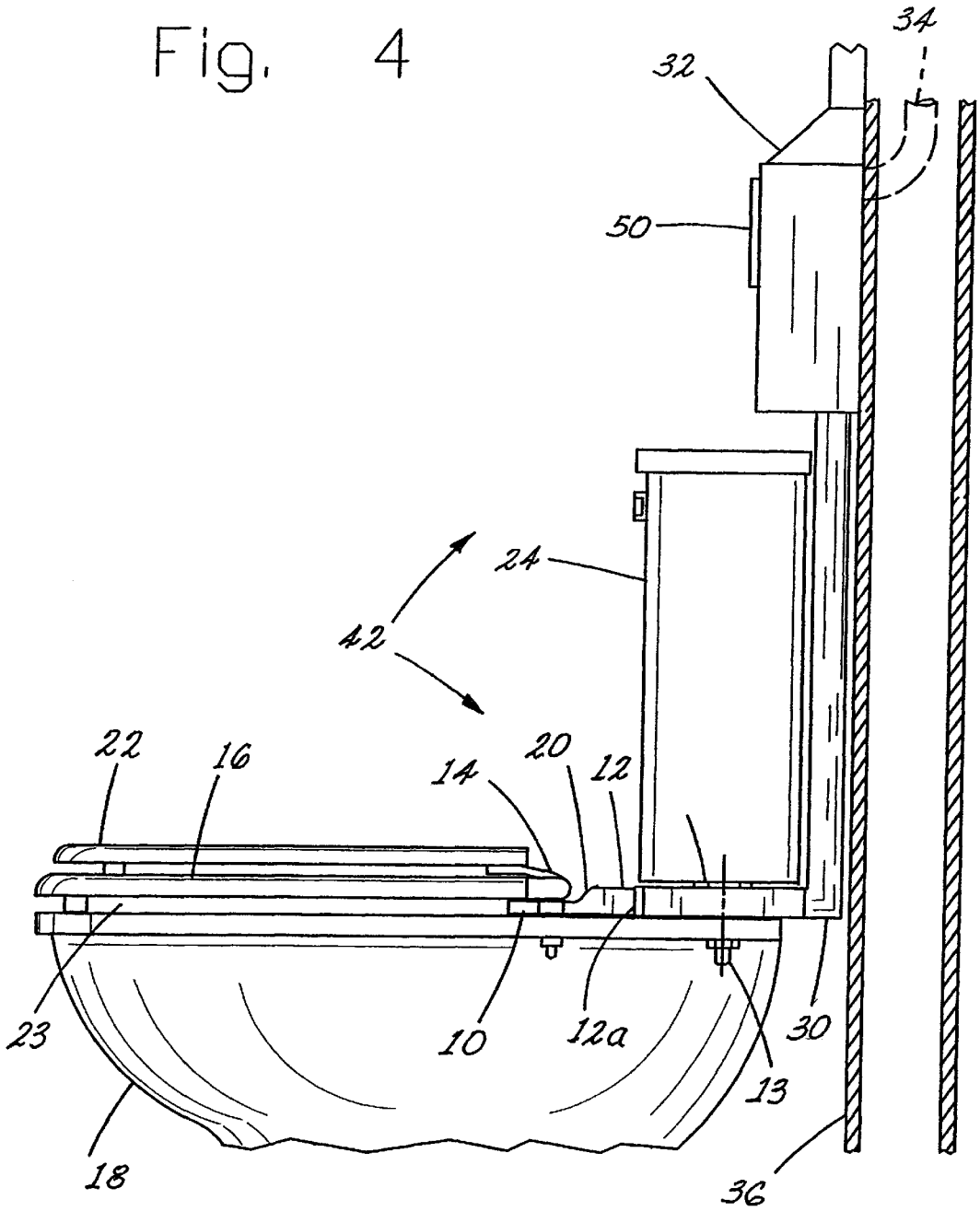

An alternate embodiment is illustrated in FIG. 4 which depicts the connector duct 30 as being attached to the back of the exhaust manifold 12 and running upwardly along the adjacent wall 36 with the heat resistant draft box 32 being above the toilet tank 24 and with the exhaust pipe 34 disposing of the fumes either within the adjacent wall 36 or into an attic space. FIG. 4 illustrates the embodiment of the invention where it is to be installed as an attachment to an existing toilet and housing the heat resistant draft box 32 and connector duct 30 within an adjacent wall 36 is either not an option or not desired.

Figure 2:
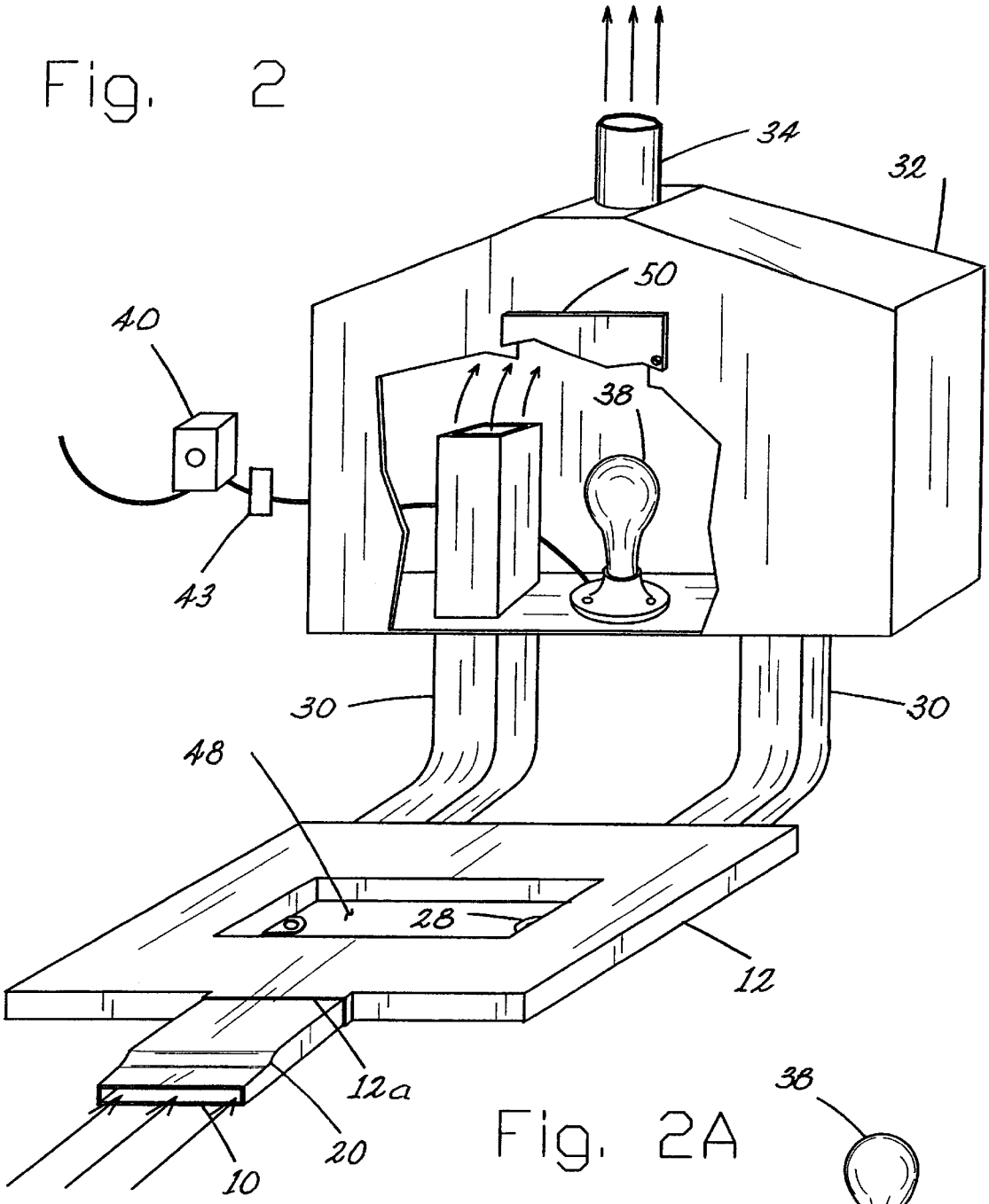
FIG. 2 is a perspective view illustrating the apparatus for ventilating a toilet, disclosing the interior of the draft box and including the attached motion detector according to the invention; and, FIG. 3 is a sectional top plan view illustrating an embodiment wherein the toilet ventilator apparatus fits under the toilet seat and beneath the toilet tank and showing the position of the central opening and gasket where fresh water passes through from tank to bowl, and the placement of spacers and pre-existing screw connections according the invention.
Figure 2A:
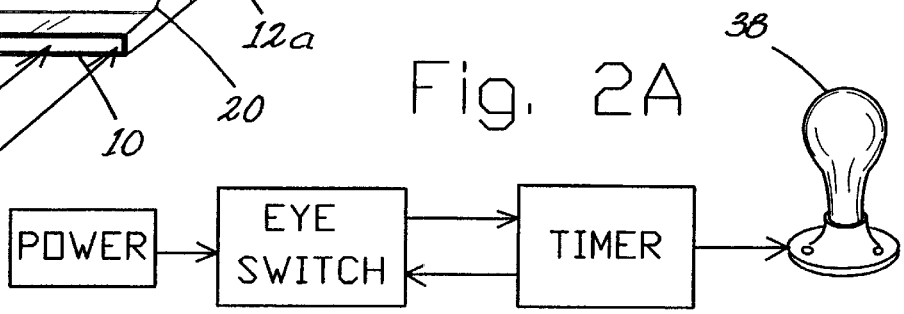
Figure 3:
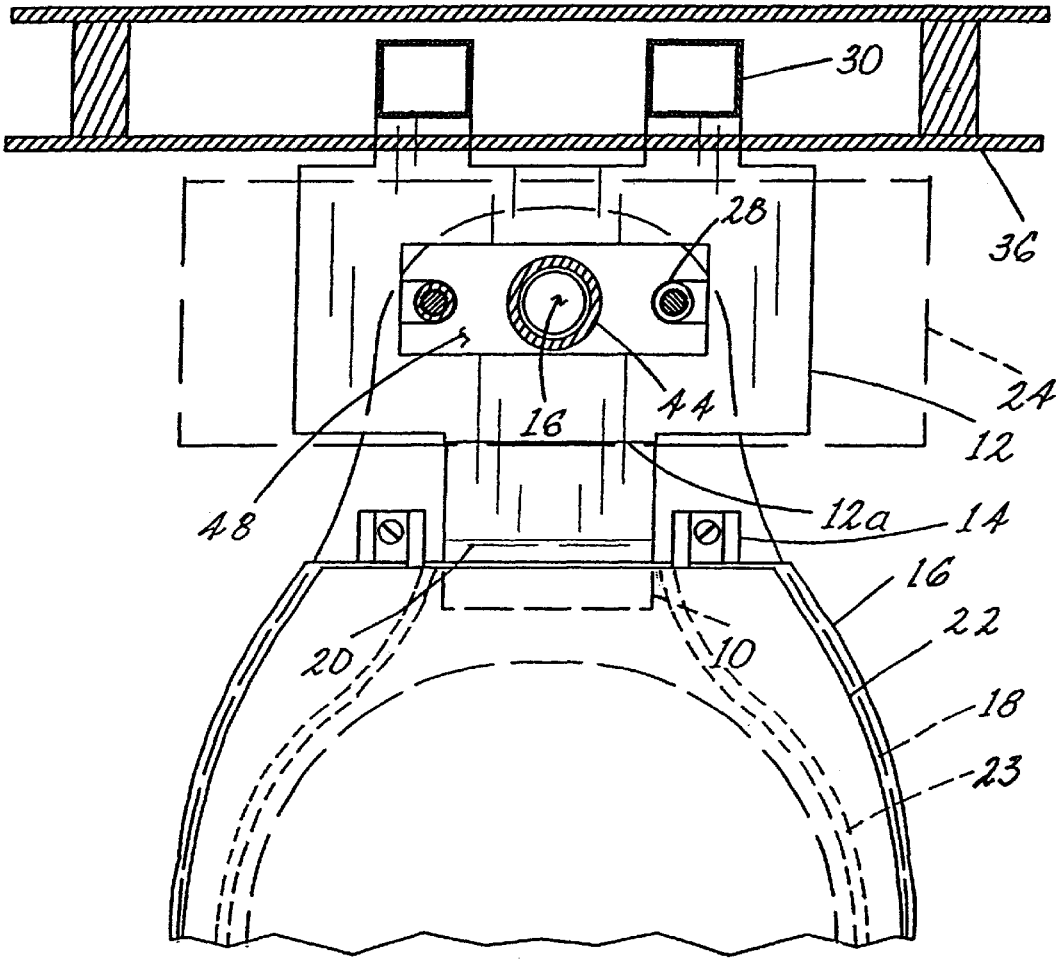
FIG. 3A is a detail illustrating the gasket and spacers to be used in accordance with an embodiment of the invention; and, FIG. 4 is a side elevation and alternate embodiment of the invention, illustrating the apparatus for toilet ventilation with the draft box being located above the toilet tank on the exterior of a wall according to the invention.
Figure 3A:
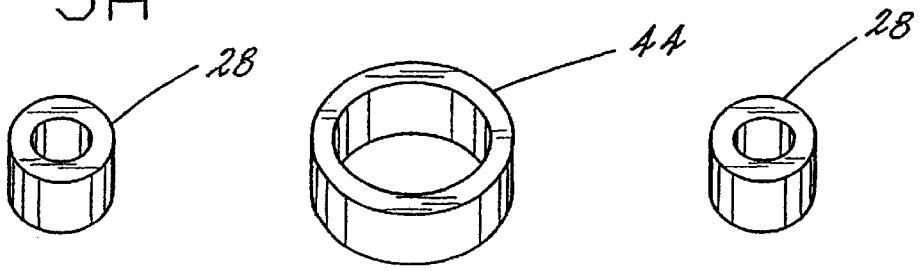

FIG. 2 illustrates heat resistant draft box 32 housing connector duct 30 and a heat source 38, preferably a light bulb, which is connected to a motion detector 40 responsible for activating the heat source 38. The heat source 38 heats the air within the heat resistant draft box 32 causing the air to rise out through the exhaust pipe 34, thereby creating a draft in the direction of arrows 39 and drawing more air into the apparatus primarily, the sullied air in the toilet bowl 18, which is then likewise expelled.

FIG. 2 illustrates the details of the circuit between the motion detector 40 and the invention's heat source 38. Ideally the motion detector 40 would sense a person approaching the toilet 42, activate the heat source 38 which operates on a timed delay, wherein a timer device 43 turns of the heat source after a preferred period of time—and line 21—page 8, line 2 to—In addition, both the aftermarket toilet ventilator and the toilet ventilator-toilet combination cab be incorporate a seal 23 attached to the underside of toilet seat 16. When the toilet lid is closed, the seal 23 between seat 16 and toilet bowl 18 further traps the odors that may escape so that the odors are drawn in by the exhaust manifold.

Both the after market toilet ventilator and the toilet ventilator-toilet combination will incorporate a gasket 44 into the central opening 46 shared by both the toilet bowl 1 8 and the toilet tank 24 through which fresh water flows from said tank 24 to said bowl 18 as the toilet 42 is flushed. The gasket 44 prevents any water leakage as it passes from the tank 24 which is raised to accommodate the exhaust manifold 12. The exhaust manifold 12 has a manifold opening 48 to accommodate the transfer of water from tank 24 to bowl 18 as well.

In addition, both the aftermarket toilet ventilator and the toiled ventilator-toilet combination can incorporate a seal 23 attached to the underside of toilet seat 16. When the toilet lid is closed, the seal between seat 16 and toilet bowl 18 further traps the odors that may escape so that the odors are drawn in by the exhaust manifold.

Both embodiments have a service door 50 on the heat resistant draft box 32 which can be opened to easily access and service or change the heat source 38. Which may advantageously be a single light bulb. When the at least one connector duct 30 and the draft box 32 are housed within a wall 36 an adjacent wall access door 52 must be used as well in order to access first the service door 50 and then the heat source 38 for changing or servicing it. If the connector duct 30 and the draft box 32 are not housed with in a wall 36, an adjacent wall access door 52 is unnecessary as the apparatus can be serviced above the tank utilizing only the service door 50. A cabinet, however, may be the preferable way to house said draft box 32 in order to allow for a more aesthetic presentation of the device versus a utilitarian one. Other means of creating an up draft of air to remove the odors from the toilet bowl without a blower or fan may also be utilized. For example, even connection of the exhaust manifold to an attic through suitable connections may be used to create an updraft due to the heated attic air. This advantageously provides a continuous draft.

Thus one can appreciate from the above description of the preferred embodiment the various advantages it has over the prior art. Advantageously, the present invention may be activated by a motion detector located most likely on the adjacent wall behind the toilet. The draft to draw the fumes out of the toilet is created by a heat source preferably located in a draft box. The heat source, preferably a light bulb, gets turned on by the motion detector when a person approaches the commode. The present invention also advantageously, requires no motor and draws the rank air out through an exhaust manifold located at the back of the toilet seat, resting under the seat, between the hinges and extending backwards underneath the tank which is raised by spacers to accommodate the manifold.

While a preferred embodiment of the invention has been described using specific terms, such description is for illustrative purposes only, and it is to be understood that changes and variations may be made without departing from the spirit or scope of the following claims.

What is claimed is:

1. A toilet ventilation system for use with a toilet assembly for venting foul odors from said toilet assembly having a bowl, tank, toilet seat and lid located in a room comprising:

an exhaust manifold disposed between the bowl and tank of the toilet;

an intake duct in fluid communication with the toilet bowl and with the exhaust manifold for receiving the foul odors from the toilet bowl;

a draft box having a service door in a side wall and disposed above said toilet tank for receiving the foul odors from said exhaust manifold;

at least one connector duct connecting said exhaust manifold with said draft box;

a heat source for creating an updraft of air in said draft box to exhaust the foul odor;

an exhaust pipe connected to said draft box for ventilating said foul odors to an outside environment;

said heat source comprising a light bulb disposed within said draft box, said light bulb being accessible through said service door;

a switch comprising a motion detector which controls said heating element in response to detecting the presence of a person in the room and turns the heating element on in response to sensing the presence of the person and a time delay device for turning the light bulb off after a predetermined period of time, after said light bulb has been turned on by said motion detector.

2. The system of claim 1 wherein said exhaust manifold includes a medial opening through which toilet tank connectors extend to attach said toilet tank to said toilet bowl.

3. The system of claim 2 including spacers disposed in said medial opening for supporting at least part of the weight of the toilet tank so that the weight of the tank does not rest upon the exhaust manifold.

4. The system of claim 3 including an attachment means cooperating with said tank connectors for attaching the exhaust manifold to the toilet bowl.

5. The system of claim 4 comprising a gasket disposed in said central opening fitted between said toilet tank and said toilet bowl for fluid sealing.

6. The system of claim 5 comprising an intake duct removable from the exhaust manifold for cleaning or replacement purposes.

7. The system of claim 6 comprising a seal attached to the underside of said toilet seat to block the escape of odors so that the odors are drawn in by the exhaust manifold.

8. The system of claim I wherein said draft box is disposed within a hollow interior behind an adjacent wall of the room, and said at least one connector duct extends through the adjacent wall to said draft box.

9. The system of claim 8 including an access door formed in said adjacent wall for accessing said service door.

10. The system of claim 1 wherein said draft box is disposed above said toilet tank and comprises a service door for access to said heat source for servicing the said heat source.

11. The system of claim 1 wherein said heat source includes an outside source of warm air in fluid communication with said draft box to facilitate said exhaust draft of air.

* * * * *